US009693598B1

(12) United States Patent
Rose

(10) Patent No.: US 9,693,598 B1
(45) Date of Patent: Jul. 4, 2017

(54) SHOE SYSTEM WITH INTERCHANGEABLE UPPERS

(71) Applicant: Veronica Rose, Boca Raton, FL (US)

(72) Inventor: Veronica Rose, Boca Raton, FL (US)

( * ) Notice: Subject to any disclaimer, the term of this patent is extended or adjusted under 35 U.S.C. 154(b) by 713 days.

(21) Appl. No.: 13/827,145

(22) Filed: Mar. 14, 2013

Related U.S. Application Data

(60) Provisional application No. 61/685,623, filed on Mar. 21, 2012.

(51) Int. Cl.
*A43B 3/24* (2006.01)

(52) U.S. Cl.
CPC ..... *A43B 3/242* (2013.01)

(58) Field of Classification Search
CPC ..... A43B 3/24; A43B 3/0078; A43B 3/242; A43B 3/246; A43B 23/24; A43B 1/0027; A43B 21/42; A43B 1/0081; A43B 13/36; A43B 3/122; A43B 3/126; A43B 3/244; A43B 1/0072; A43B 21/39; A43B 3/103; A43B 3/105; A43B 21/38; A43B 21/00
USPC ..... 36/100, 15, 12, 11.5, 101, 36 R, 42
See application file for complete search history.

(56) References Cited

U.S. PATENT DOCUMENTS 2,510,236 A * 6/1950 Kutcher ..... A43B 3/24 36/101
2,552,943 A * 5/1951 Danielius ..... A43B 3/24 36/101
2,873,540 A * 2/1959 Murphy ..... A43B 3/24 36/101
4,114,296 A * 9/1978 Smith ..... A43B 3/24 36/101
4,416,072 A * 11/1983 Sarkissian ..... A43B 3/24 36/100
4,586,209 A * 5/1986 Bensley ..... A43D 25/06 12/142 D
5,675,916 A * 10/1997 Lewis ..... A43B 21/46 36/36 R
5,802,738 A * 9/1998 Ferniani ..... A43B 3/103 36/101
6,442,870 B1 * 9/2002 Tsai ..... A43B 3/103 36/100
7,174,657 B2 * 2/2007 Berg ..... A43B 1/0027 36/101

(Continued)

FOREIGN PATENT DOCUMENTS

EP 0 888 729 A1 1/1999

OTHER PUBLICATIONS

D8 DZUS® PANEX Quarter-Turn Fasteners Retainers and Accessories• Size 6 attached as D8.en.pdf; downloaded from http://www.southco.com/en-us/d8 on Mar. 16, 2013; date of publication unknown; see D8.en.pdf pp. 7, 11-12, bearing page Nos. 292, 296-297.

*Primary Examiner* — Anna Kinsaul
*Assistant Examiner* — Catherine M Ferreira
(74) *Attorney, Agent, or Firm* — Collard & Roe, P.C.; Christopher Garvey

(57) ABSTRACT

A shoe system has an interchangeable upper. The shoe includes a shank (6); a heel (9); and a platform (8). The shank is assembled to the heel. A fastener (37) joins the shank (6) and the platform (8). The shank (6) and the platform (8) are configured to removably assemble to each other. The shank (6) and the platform (8) are removably joined together by the fastener (37).

4 Claims, 14 Drawing Sheets

(56) References Cited

U.S. PATENT DOCUMENTS

| | | | | |
|---|---|---|---|---|
| 7,185,448 | B2 * | 3/2007 | Schupbach | A43B 3/24 36/100 |
| 7,219,445 | B2 | 5/2007 | Stern et al. | |
| 7,578,075 | B1 * | 8/2009 | Kemp | A43B 3/24 36/100 |
| 2013/0219751 | A1 | 8/2013 | Catlett | |

* cited by examiner

SHOE SYSTEM WITH INTERCHANGEABLE UPPERS

PREVIOUS APPLICATIONS

This application is a non-provisional application of provisional application 61/685,623 filed Mar. 21, 2012. Priority and benefit of that application is claimed for all subject matter that may be common to these two applications.

FIELD OF INVENTION

The present invention is a shoe system in which a removable upper portion of a shoe may be interchanged with other uppers, in order to change the appearance of the shoe.

BACKGROUND OF THE INVENTION

The present invention relates to footwear. More specifically to shoes, styled for women, having an interchangeable upper part to change the appearance of the shoes.

DESCRIPTION OF PRIOR ART

Footwear comes in an endless variety of styles and designs to fit all sorts of functionality and decorative needs a woman encounters when it comes to wearing shoes. It can be very costly to be able to match different styles and colors of shoes with each different outfit. More importantly, it can be very challenging to store numerous pairs of shoes, and even more so when travelling.

SUMMARY OF THE INVENTION

This invention gives a solution, to overcome the above problems, by providing footwear with interchangeable uppers/tops, to allow wearing different styles without changing the entire shoe, but changing only the uppers. Each different upper part gives a totally different look to the shoe. Preferably, each upper part has a different style, shape and color. The material used can be much diversified: it can be leather, as well as synthetic fabric. Endless possibilities may be achieved by using the same pair of soles. To have an even wider variety of interchangeable possibilities this shoe also has a small mechanism toward the back of the sole, at the heel, in which we can insert a strap with the buckle, which would match the top in style and color, so the shoe would have a more formal touch. This solution help the customer save financial resources when purchasing many pairs of shoes and, of course, saves a lot of space for storage and travelling.

The interchangeable shoe is built through a detachable system having an upper, mid-sole or shank, and a plateau or platform. The interchangeable upper can be of any material, style and color. The toe piece part of the upper may be attached from side to side like a continuous band. The part that goes on top of the mid-sole is the part that touches the foot, and is stylish and appealing to the eye. The bottom part (which doesn't show when the shoe is worn) is functional, with a few small locating holes on each side. (FIG. 2)

These holes are precisely positioned so the upper is secured to the bottom part of the mid-sole, which has a preset protrusions area where corresponding holes will be located, by means of a locking system device. The locking device can be of any material, such as metal or plastic. The locking takes place by placing (FIG. 3) the upper around the mid-sole, which has correspondingly placed pins. Interlocking means are aligned on the plateau by the interlocking and compression of the upper between the mid-sole and the plateau, by means of a fastening device such as a screw or the like. The top part of the shank has a movable hatch in the insole. The hatch part covers the fastening device, which is hidden, so it is not visible when walking. When the customer wants to switch the interchangeable upper, she will:

open the latch in the inner sole,
raise the lifting ring,
unlock the plateau from the upper and mid-sole through the fastener device by turning it about 90 degrees,
take the upper off of the midsole or shank,
insert another upper of her liking,
align the upper's small holes over pegs below the shank.

Then align the plateau with the upper and mid-sole, compress the assembly, and lock the assembly together again by rotating the fastening device 90 degrees. Now the shoes have a new decorative look and style, in just seconds.

To give and additional look or a more formal look to the shoes, the customer can also add a strap with a buckle, to be fastened on the ankle. The heel strap is mounted under a slit at the heel of the shoe, where the strap is held.

BRIEF DESCRIPTION THE DRAWINGS

Figure 5:
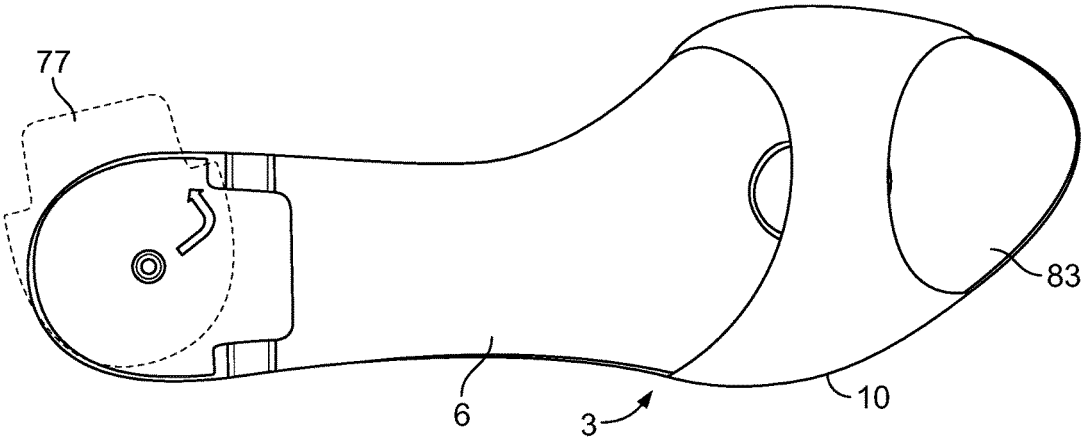

FIG. 5 a top plan view thereof.

Figure 6:
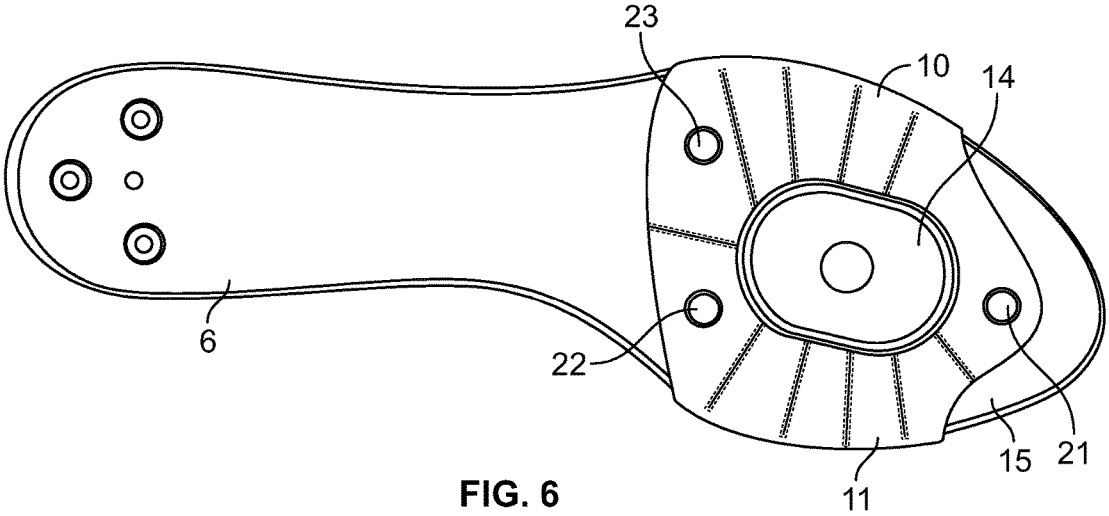

FIG. 6 is a bottom plan view of the shank assembled to the toe strap.

Figure 7:
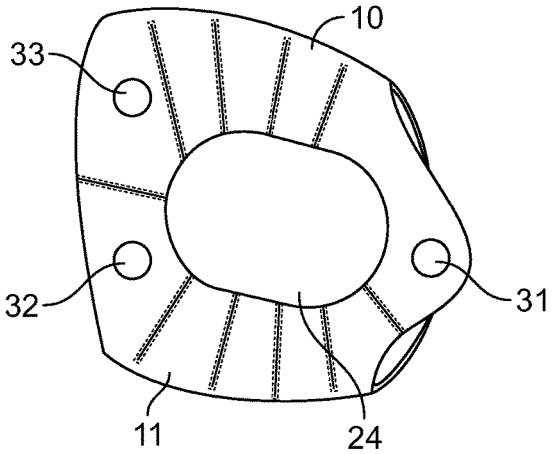

FIG. 7 is a bottom plan view of the toe strap.

Figure 8:
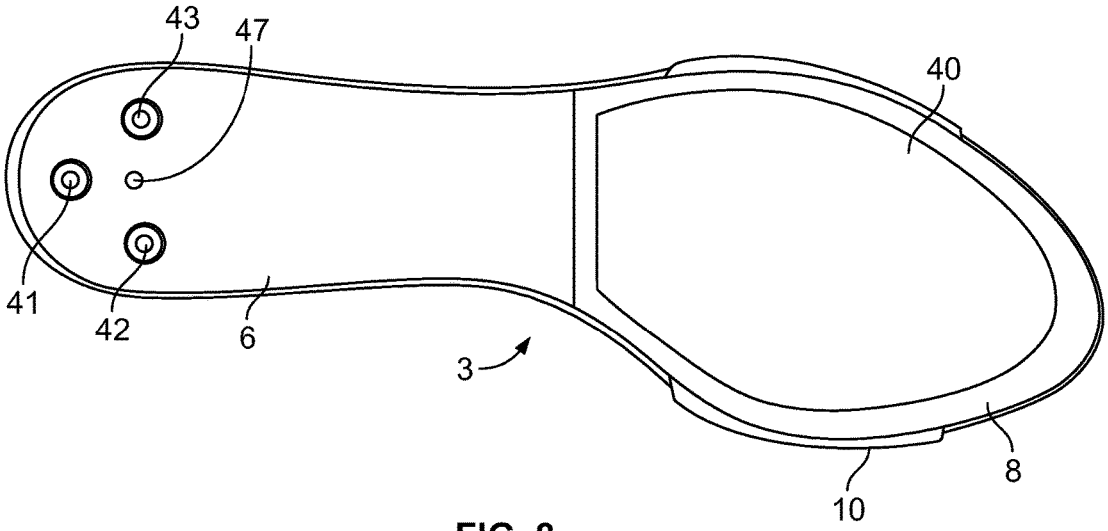

FIG. 8 is a bottom plan view of the shank assembles to the platform.

Figure 9:
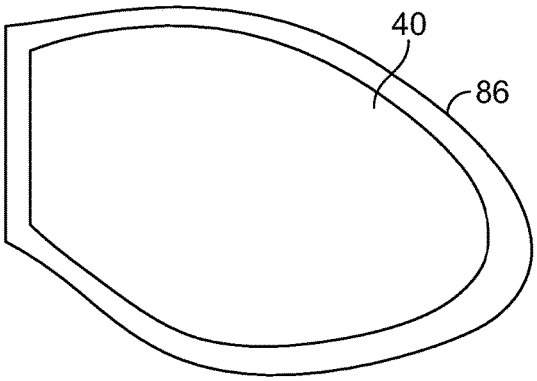

FIG. 9 is a bottom plan view of the platform.

Figure 10:
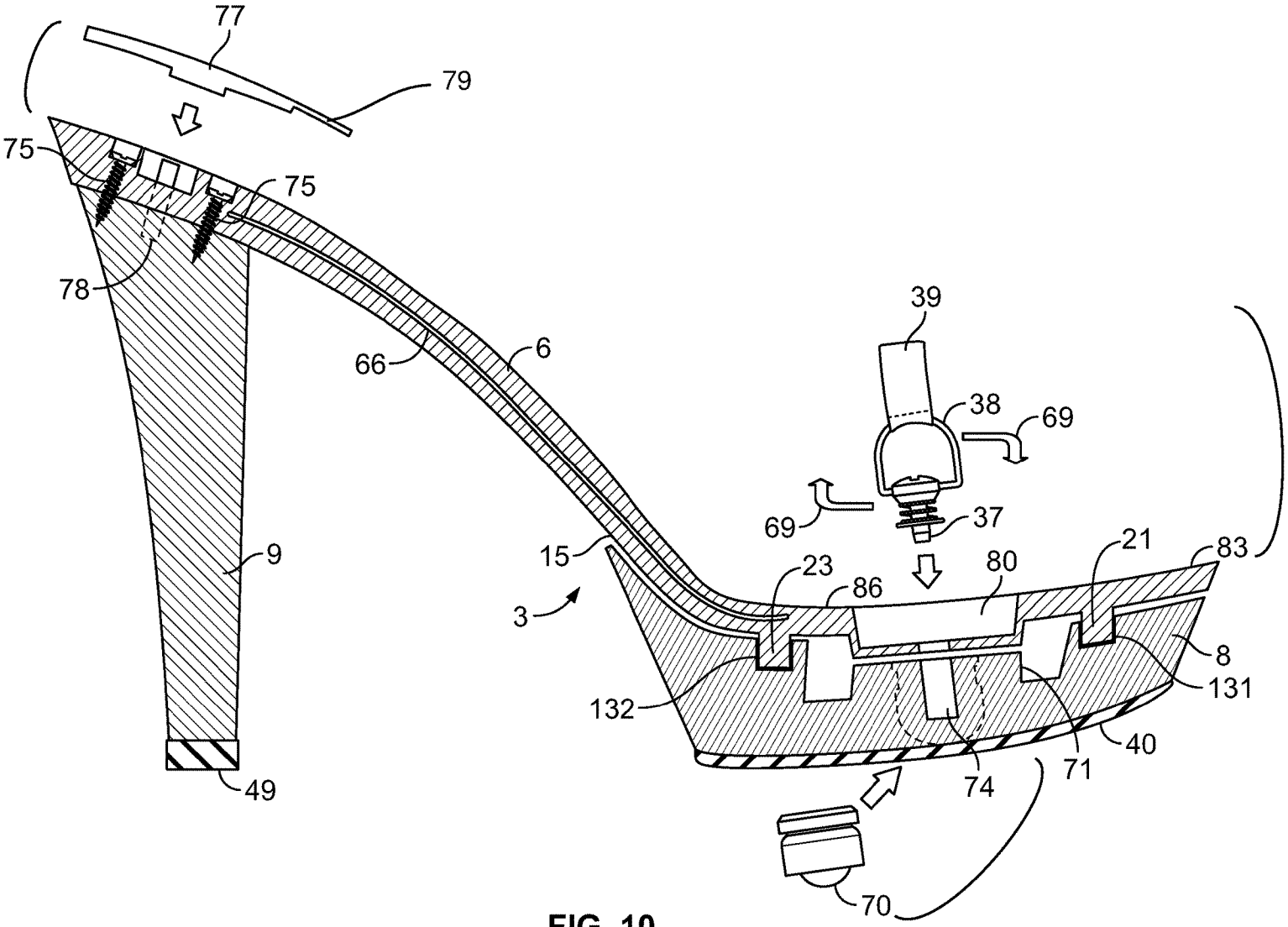

FIG. 10 is a partially exploded side elevation in section, through plane the approximate middle of the shoe.

Figure 11:
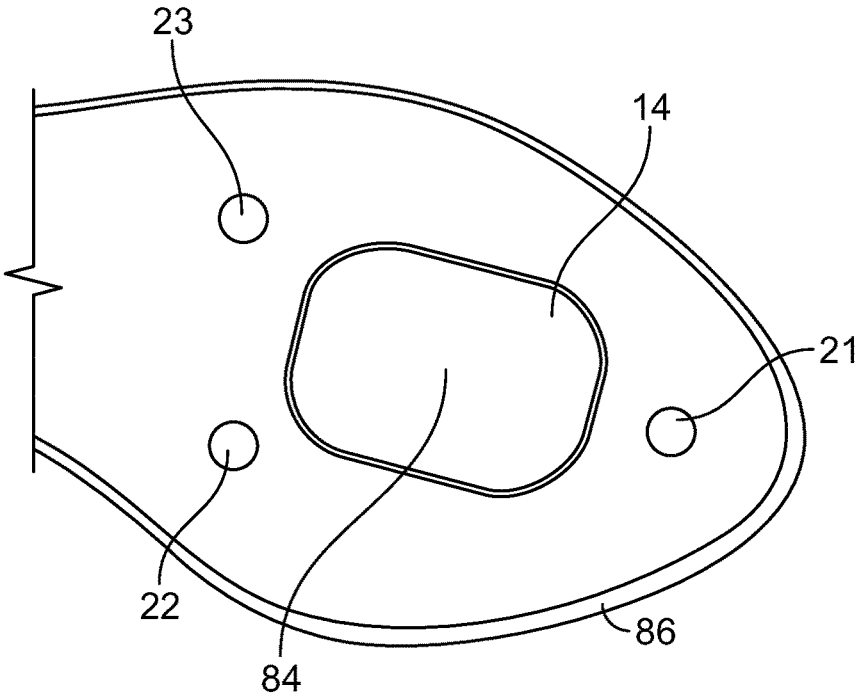

FIG. 11 is a bottom plan view of the toe portion of the shank.

Figure 12:
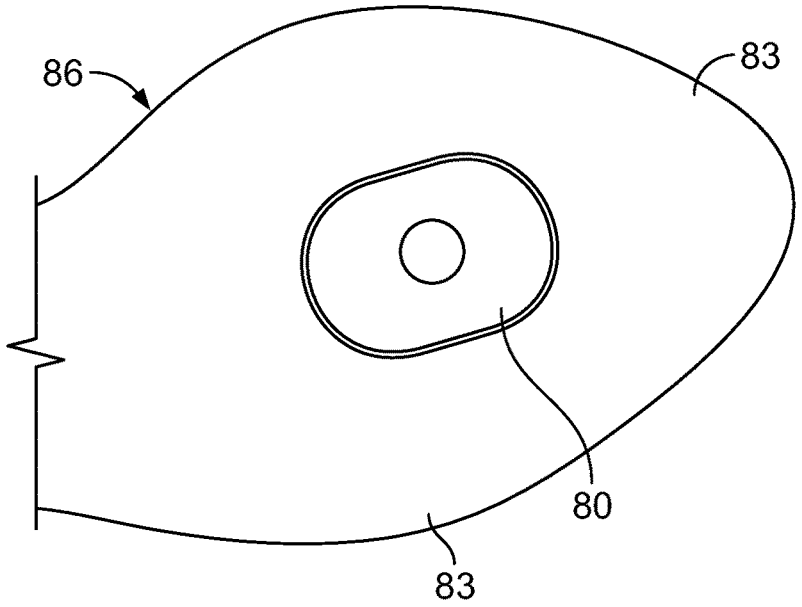

FIG. 12 is a top plan view thereof.

Figure 13:
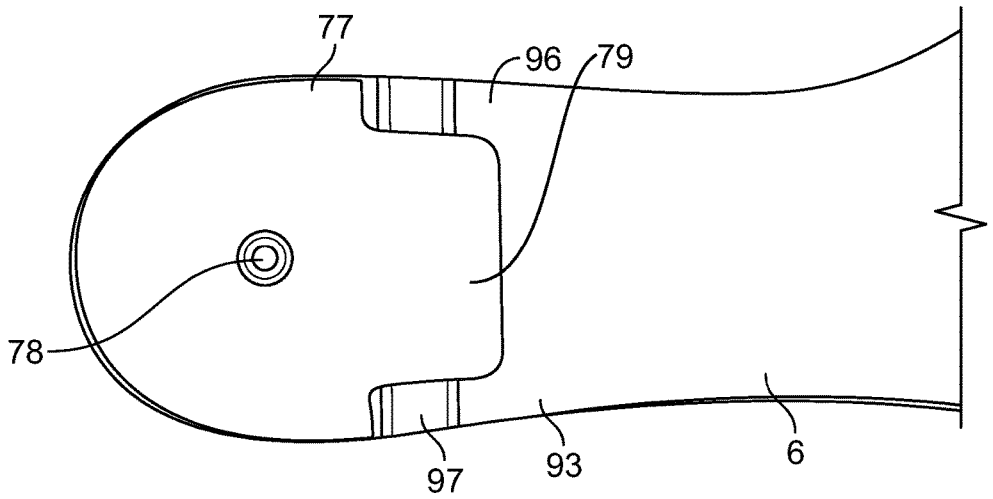

FIG. 13 is a top plan view of the shank with the heel plate rotated closed.

Figure 14:
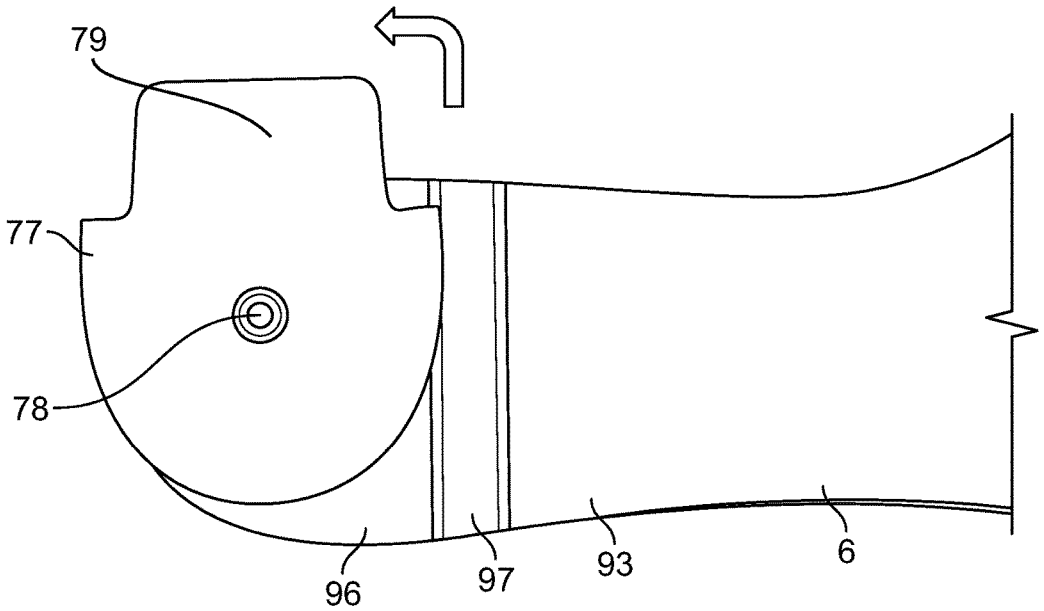

FIG. 14 is a top plan view of the shank with the heel plate rotated open.

Figure 15:
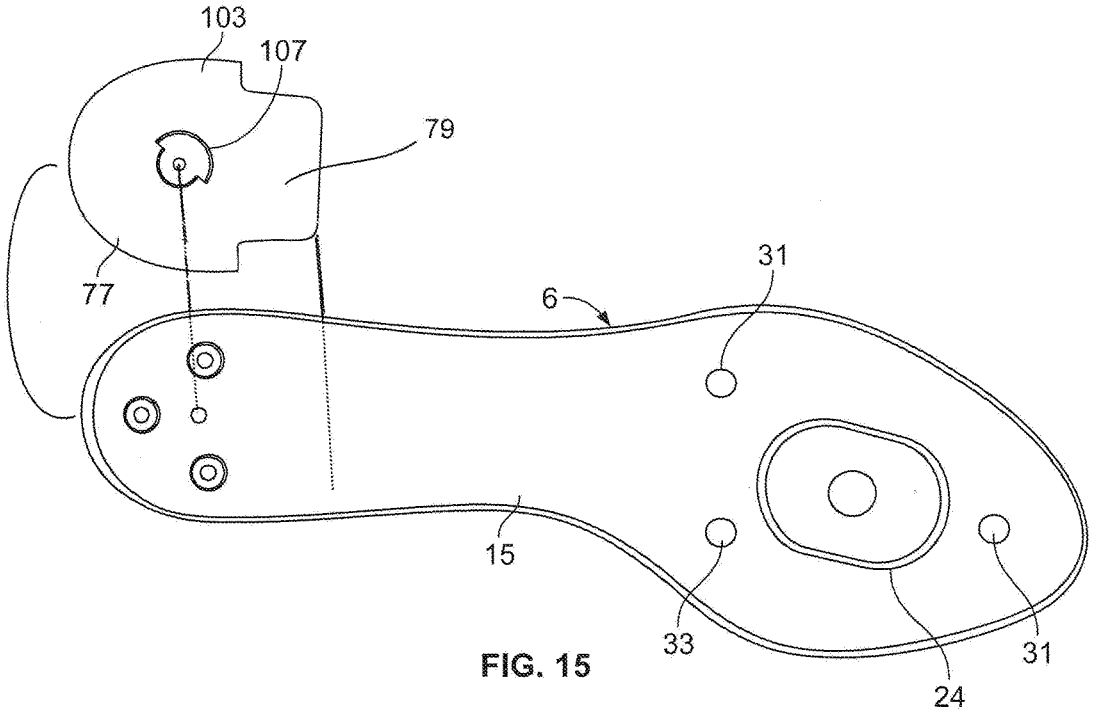

FIG. 15 is a bottom plan view change the steel plate loaded away up off the shank.

Figure 16:
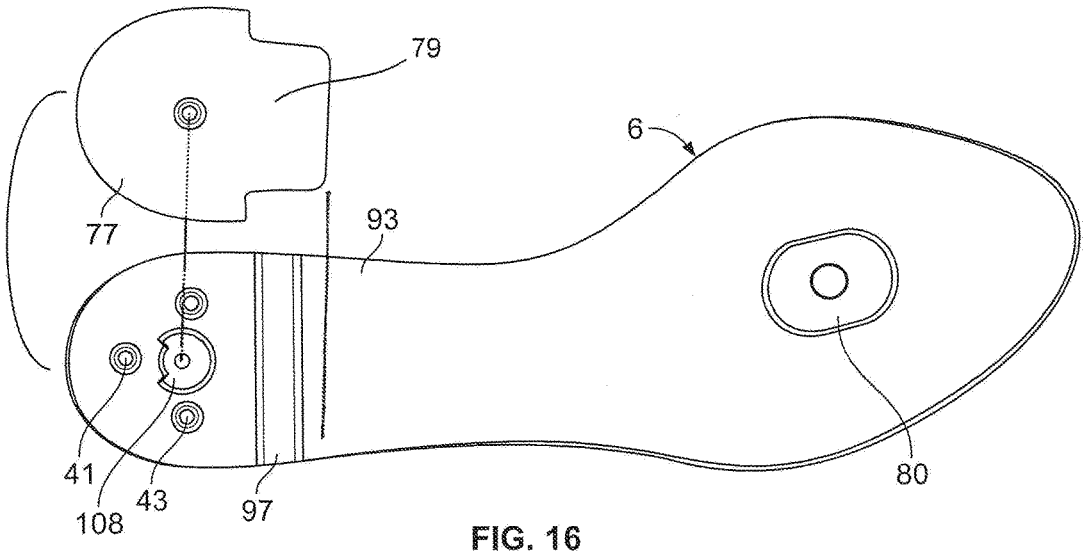

FIG. 16 is a similar top plan view thereof.

Figure 17:
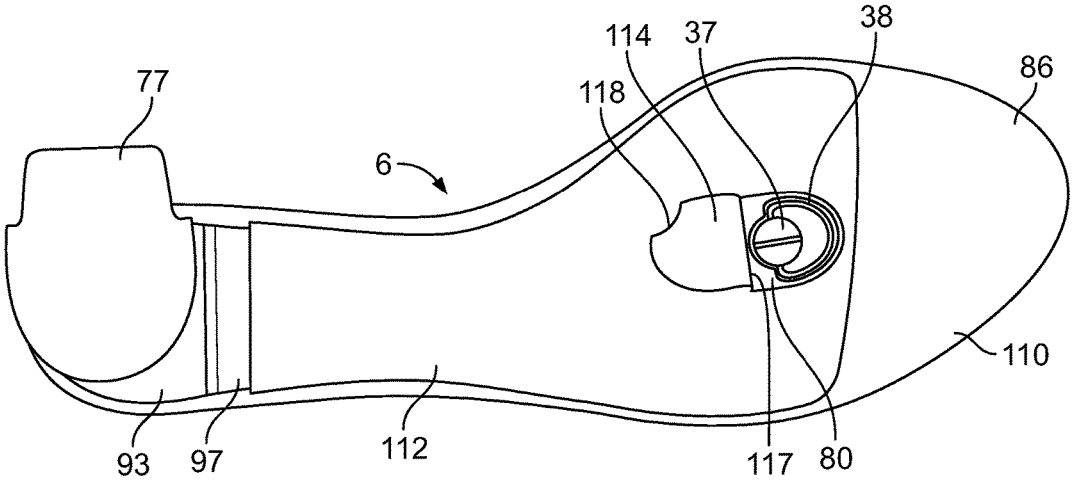

FIG. 17 is a similar top plan view with the heel plate and manhole open and the shank covered with leather.

Figure 18:
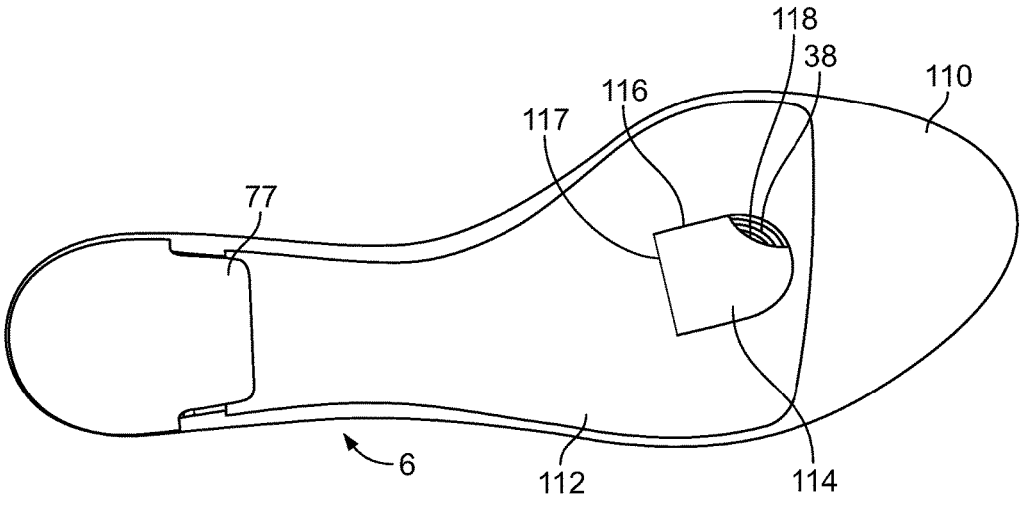

FIG. 18 is a similar top plan view, with the heel plate and manhole closed.

Figure 19:
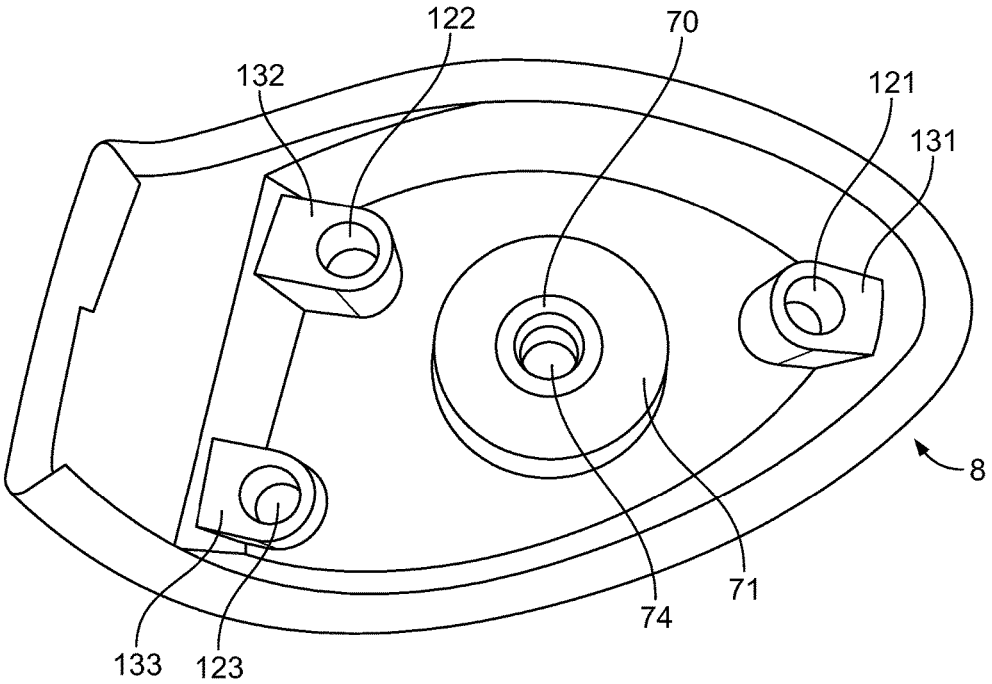

FIG. 19 is a top plan view of the platform.

Figure 20:
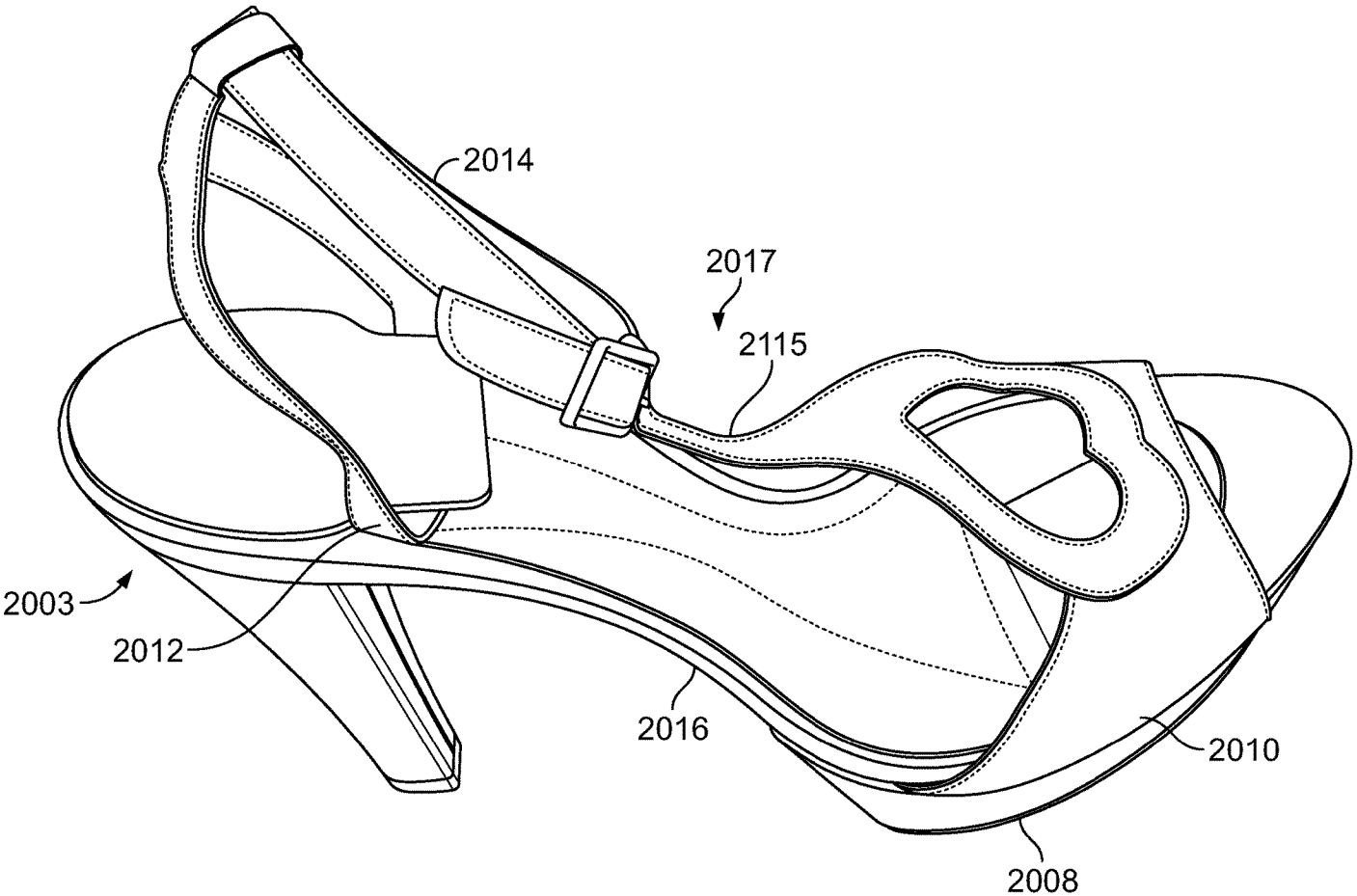

FIG. 20 is an oblique perspective view of alternative embodiment of the shoe.

Figure 21:
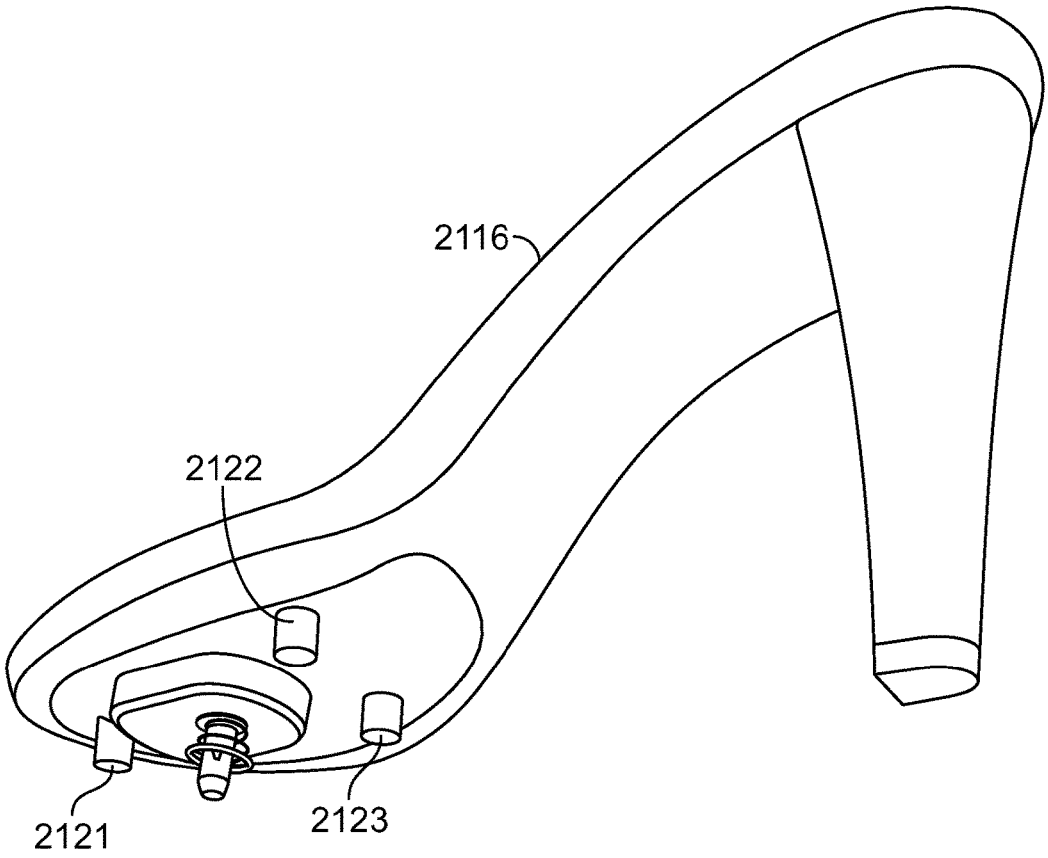

FIG. 21 is an oblique perspective view of still another embodiment showing a shank disassembled from an alternative upper. The platform is not shown.

Figure 22:
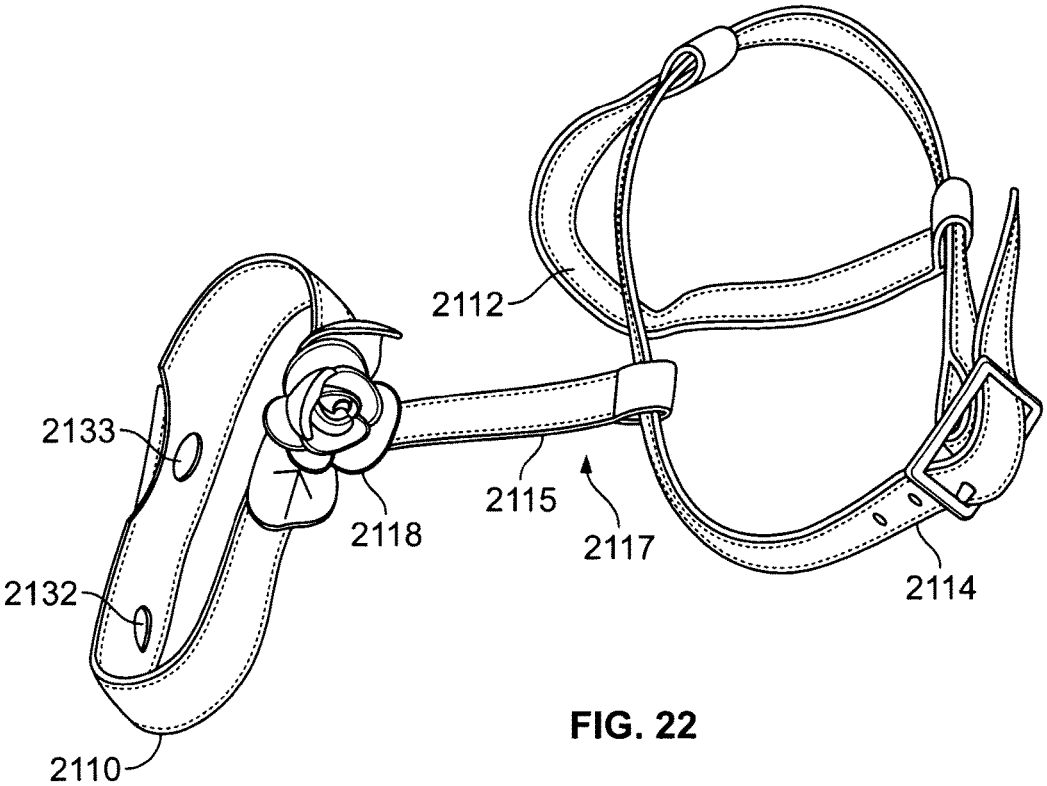

FIG. 22 is an oblique perspective view of the alternative upper, now deleted from FIG. 21, which would attach to the shank of FIG. 21.

DETAILED DESCRIPTION OF THE DRAWINGS

Figure 1:
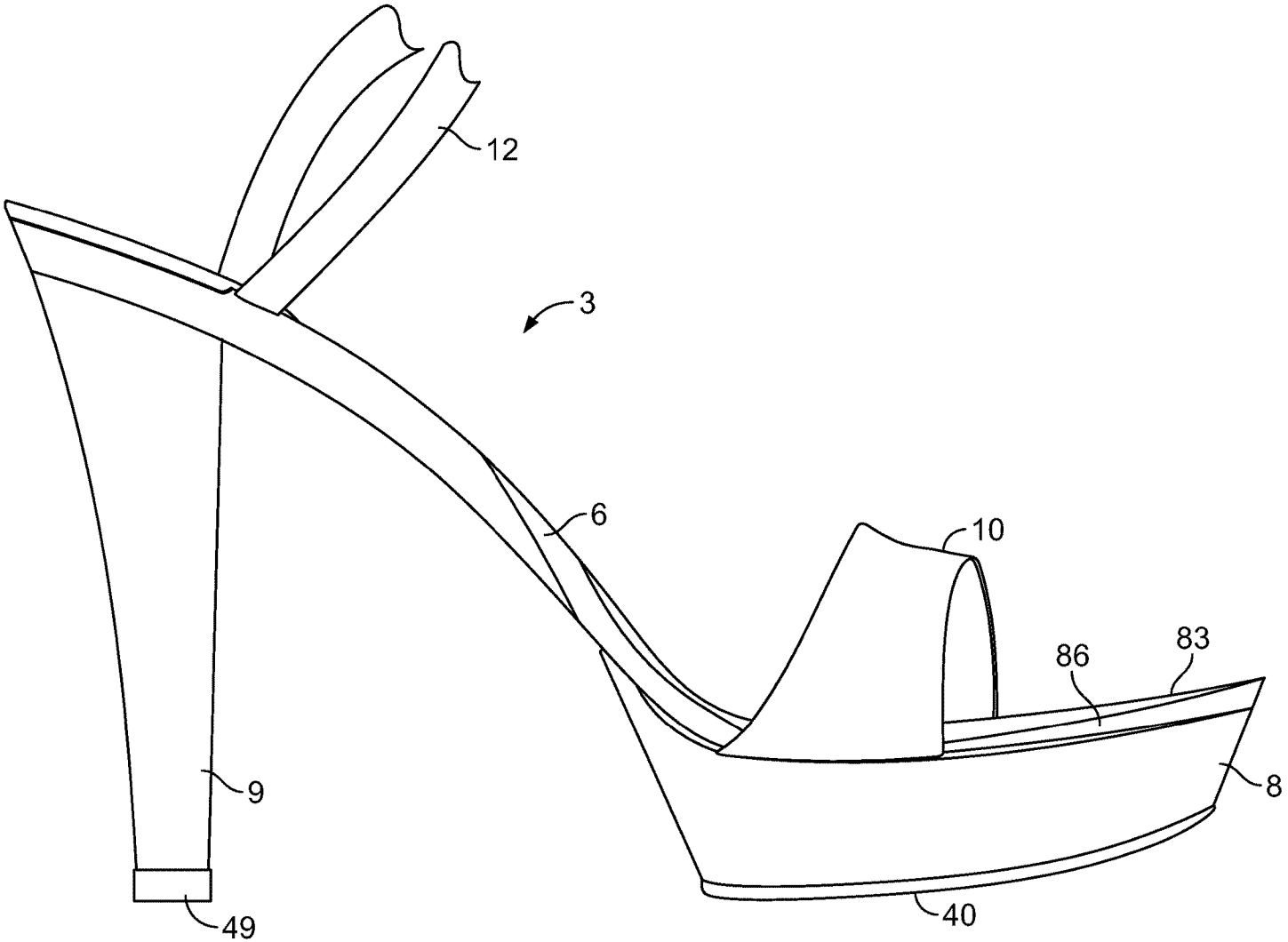
FIG. 1 is a right side elevation of a first embodiment of the present invention.

FIG. 1 shows the shoe, generally designated 3.

The main body of the shoe 3 comprises a shank 6. Shank 6 may be stamped of metal, cast or molded of plastic, carved of wood, or laminated. Shank 6 needs to be strong and to support the weight of a moving woman, as is conventional with any high-heel shoes or platform shoes.

Platform 8 is removably secured to the bottom of the front portion of shank 6.

Heel 9 is fixedly attached to shank 6 by screws or other fasteners.

In the alternative, heel 9 can be formed integrally with shank 6.

Toe strap 10 is removably attached between shank 6 and platform 8, by the pressure of a releasable attachment between platform 8 and shank 6.

Heel strap 12 is also removably attached to shank 6. Heel strap 12 is shown truncated, to represent any of many possible heel-strap configurations.

By changing:

platform 8, toe strap 10, and/or heel strap 12, to one or more sets of different corresponding parts, each set having different appearances and configurations, different shoe styles and colors may be configured to the same shank and heel, or to various other shanks and heels.

Thus, a single pair of shoes can serve as shoes of many different styles and colors, for different outfits.

This can be particularly useful if the woman is attempting to travel light, but to still have more than one style of shoes to fit her different outfits.

The heaviest part of the shoe 3 is the shank 6. The lightest parts of the shoe 3 are straps 10 and 12. Straps 10 and 12 provide the most dramatic changes of style and color.

Figure 2:
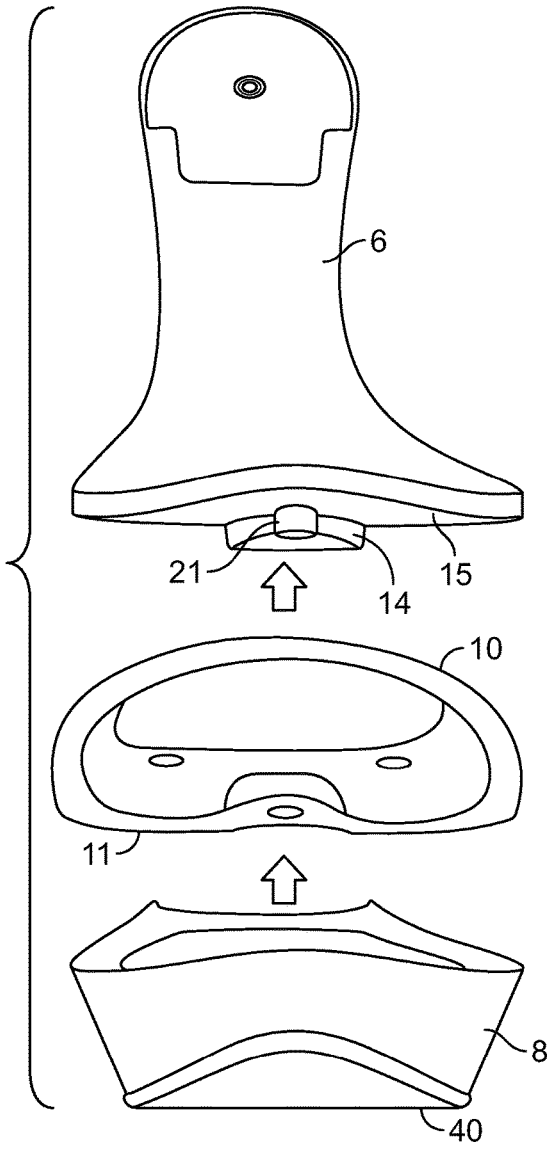
FIG. 2 is an exploded front view thereof.
Figure 3:
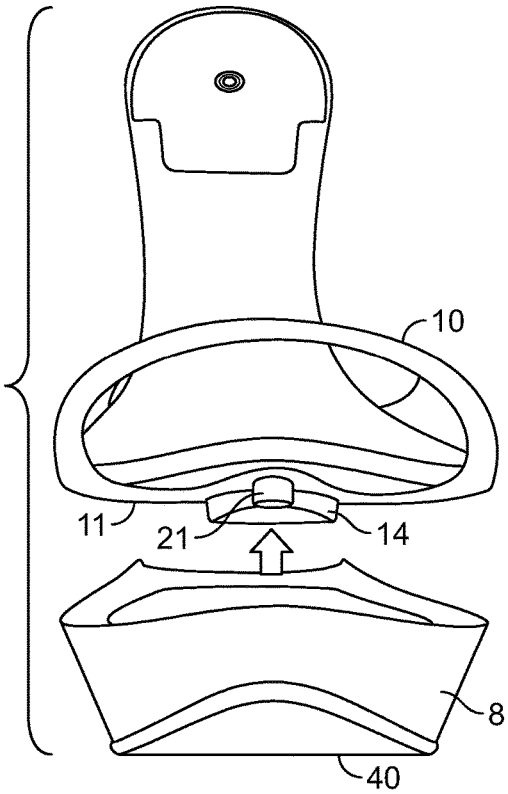
FIG. 3 is a similar exploded front elevation with toe strap assembled to the shank.
Figure 4:
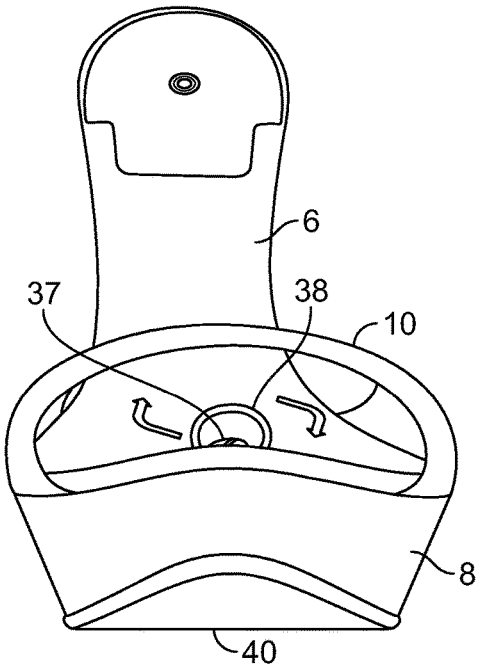
FIG. 4 is a similar front elevation showing the shank of strap and platform assembled together.

FIGS. 2-4 illustrate how strap 10 is secured between shank 6 and platform 8.

As shown in FIG. 6, from the bottom surface 15 of shank 6, pegs 21-23 and shank turret 14 protrude.

FIG. 7 shows peg holes 31-33, and turret hole 24, in the bottom of toe strap 10, configured to cooperatively locate on pegs 21-23 and shank turret 14, as in FIG. 6. These pegs 21-23, are forward peg 21, right peg 22, and left peg 23 protruding from this right foot's shank 6. In FIG. 7 the toe strap 10's corresponding holes are: turret hole 24, forward hole 31, right hole 32, and left hole 33.

FIG. 2 is an exploded view of shank 6, toe strap 10, and platform 8, in vertical alignment, as step 1 of the assembly process.

FIG. 3 shows step 2 of the assembly process. Toe strap 10 has been aligned with shank 6's pegs in toe strap 10's holes. The assembler elevates platform 8 so that three platform recesses align with shank pegs 21-23. Platform 8 and shank 6 are pressed together holding strap 10 captive therebetween.

FIG. 4 shows step 3 of the assembly process. A commercially available D8 PANEX quarter-turn screw 37 comprises a lifting ring 38, which is lifted and used to turn screw 37 one quarter turn, in a clockwise (when viewed from the top) direction, to engage a cooperative socket, and to pull shank 6 and platform 8 together, thereby holding strap 10 securely therebetween.

Lifting ring 38 is then lowered below the upper surface of shank 6 so that it is out of the way.

FIG. 1 shows strap 10 in place on shoe 3.

FIGS. 8 and 9 show platform 8 from its underside, including outer sole 40, which may be adhesively or otherwise attached to the bottom surface of platform 8.

FIG. 8 shows platform 8 after it has been assembled to shank 6, and secures front strap 10 therebetween.

FIG. 8 also shows the underside of shank 6 at the heel, before attachment of heel 9. Heel screw-holes 41-43 can be seen for securement of the heel 9. Hole 47 is provided for mounting a pin.

FIG. 10 is a side elevation of shoe 3, in section, near a longitudinal centerline of the shoe 3.

In FIG. 10 we see heel outer sole 49.

Metal shank reinforcement 66 is, in the preferred embodiment, made of steel. It has been cast into a plastic material from which shank 6 is molded.

Quarter-turn socket 70 is shown, exploded away from, and with an arrow pointing to, socket 70's recessed location in platform 8, into which socket 70 has been molded.

Platform turret 71 presents female threaded hole 74.

Screw 37 is shown exploded away from its normal position. Screw 37 is normally attached, set inside a recess, which recess we will call manhole 80. The only part of a man, or a woman, that recess 80 is large enough for, is a fingertip. But recess 80 serves a function similar to that of a manhole, a function of providing normally-closed, foot-supporting access to a functional part, that is, to screw 37. Rotational arrows 69 show that when screw 37 is turned in a clockwise direction, it pulls on corresponding threads in socket 70, pulling platform 8 securely to shank 6.

In this embodiment, heel screws 75 attach heel 9 to the bottom of shank 6.

Inner heel plate 77 is rotatably secured to heel pin 78.

FIG. 11 shows the bottom surface of the forward part 86 of shank 6.

Turret 14 presents screw hole 84 for the mounting screw 37.

FIG. 12 shows the upper surface 83 of the forward portion 86 of shank 6, into which manhole 80 is recessed.

FIG. 13 shows upper surface 93 of heelward part 96 of shank 6. FIG. 14 also shows the heelward part 96 of the upper surface 93 of shank 6 with reference numeral 96 pointing to a different area of the heelward part than FIG. 13. Groove 97 runs transversely across the heelward part 96 of the upper surface 93 of shank 6.

Groove 97 provides a space, into which heel strap 12 may be secured by heel plate 77. As shown in FIG. 14, plate 77 is rotated counterclockwise, open 90°, on pivot 78, uncovering tab 79 from groove 97, to expose groove 97. Heel strap 12 may be then located into groove 97. Heel plate 77 is then rotated 90° clockwise to its closed position, as in FIG. 13, to secure heel strap 12 by placing tab 79 over groove 97, as shown in FIG. 13.

FIG. 15 is an exploded bottom plan view of shank 6. Bottom surface 103 of heel plate 77 comprises a protrusion 107 which guides and controls the rotation of the heel plate 77, in conjunction with recess 108 in FIG. 16, to limit the heel plate 77's rotation to 90°.

FIGS. 17-18 show shank covering 110, which may be any flexible and durable shoe lining material, such as leather, deerskin, goatskin, or fabric.

Inner sole 112 is of similar material, preferably thicker.

Hatch 114 is formed in inner sole 112 by:

cutting curved line 116, through inner sole 112; and by scoring underneath across straight line 117, to form an upward-opening leather hinge, at score 117.

Notch 118 is formed in hatch cover 114 to allow a user's fingernail to get under hatch 114 and lift hatch 114 up, as in FIG. 17, to expose manhole 80, screw 37, and lifting ring 38.

Inner sole 112 is adhesively attached atop shank covering 110.

There will preferably be a thin piece of leather secured around lifting ring 38, to allow a user to pull the ring 38 up, which ring 38 can be too stiff to lift by a finger nail, particularly when obstructed from above, by toe strap 10.

FIG. 19 is a perspective view of the open top of platform 8. Secured in turret 71 is quarter-turn PANNEX screw socket 70, in which is a specially configured screw hole 74, ready to receive corresponding quarter-turn screw 37.

To receive pegs 21-23 (FIG. 11), holes 121-123 (FIG. 19) are recessed into buttresses 131-133. These buttresses serve to locate holes 31-33 onto pegs 21-23, and to thereby secure toe strap 10 as shown in FIGS. 6 and 7.

The presently preferred means of attaching platform 8 to shank 6 is a commercially available PANEX quarter-turn screw and socket attachment device. This quarter-turn screw and socket is more fully described in the information disclosure statement, and in its accompanying references, to be filed with this application. The PANEX quarter-turn screw and socket are hereby incorporated by reference.

FIG. 20 is an alternative embodiment of an assembled shoe 2003 in which toe strap 2010 and heel strap 2012 are connected together by ankle strap 2014 and center strap 2015 across shank 2016 to create upper strap assembly 2017.

FIG. 21 shows, unassembled, yet another alternative embodiment in which toe strap 2110 and heel strap 2112 are tied together by ankle strap 2114 and the center strap 2115 to be mounted on shank 2116 as an upper strap assembly 2117. A decorative piece 2118, in this case a flower, is mounted atop toe strap 2110. Because toe strap 2110 is narrower than in the above embodiments, peg 2121 does not engage with the nonexistent forward part of toe strap 2110. Only pegs 2122 and 2123 engage with holes 2132 and 2133 of toe strap to 10.

It may be understood that many further embodiments may be designed using a multiplicity of strap configurations, colors, patterns, strap materials, design elements, widths, stitches, buckles, ribbons, ties, etc. These may be combined with shanks and platforms of great variety in colors, materials, and patterns.

Although this invention has been described with specific arrangements of parts or features, these are not intended to exhaust all possible variables within the same invention, so any modification that has the same final result, to obtain an interchangeable shoe with a similar structure, will still be within the spirit of the present invention.

I claim:

1. A shoe system comprising:
a shank;
a forward part of the shank;
a heel;
said shank affixed to said heel;
a bottom surface of the shank;
a bottom surface of the forward part of the shank;
a plurality of protrusions;
said protrusions depending from the bottom surface of the forward part of the shank;
the protrusions comprise:
a shank turret; and
three shank pegs, including: a forward peg, an inside peg, and an outside peg;
a recess in the shank turret;
a screw fastener rotatably mounted in the recess in the shank turret; and
a platform;
an upper surface of said platform;
a toe strap;
said toe strap having a bottom portion;
a plurality of strap locating holes in the bottom portion of said toe strap;
said strap locating holes cooperatively sized and spaced to receive the protrusions;
three platform locating holes, atop said platform;
said platform locating holes cooperatively sized and spaced to the three shank pegs;
said three platform locating holes including:
a forward peg hole, cooperatively sized and spaced to receive the forward shank peg;
an inside peg hole, cooperatively sized and spaced to receive the inside shank peg; and
an outside peg hole cooperatively sized and spaced to receive the outside shank peg;
a platform turret on the platform;
a fastener receiver fixedly mounted recessed in the platform turret said fastener receiver is a quarter-turn socket configured:
to receive the screw fastener in releasable locking engagement between the screw fastener and the fastener receiver by rotation of the screw fastener clockwise, thereby securing:
the platform to the shank, and
the bottom of the toe strap compressed between the shank and the platform;
to release the screw fastener from the fastener receiver by rotation of the screw fastener counter-clockwise;
thereby releasing the platform from the shank.

2. A shoe system according to claim 1, which shoe system:
said quarter-turn screw is rotatably mounted inside the recess;
the upper surface of the shank is covered by an insole;
a hatch is configured as a foot-supporting surface, coplanar to the insole surrounding said hatch,
the hatch is mounted on a hinge;
the hatch is configured to close on the hinge over the recess;
the hatch is configured to open for access to the recess;
the hatch includes a notch, configured for insertion of a fingernail, to open the hatch.

3. A shoe system according to claim 2, which shoe system comprises:
a heelward part of the upper surface of the shank;
a heel pin, affixed to the shank, and recessed below the heelward part of the upper surface of the shank;
the heel plate is secured to the heel pin; and
the heel plate is configured to rotate, around said heel pin, the heel plate rotating, parallel to and adjacent the heelward part of the upper surface of the shank;
the shank turret presents has a screw hole;
the mounting screw is rotatably screwed through the screw hole in the bottom surface of the forward part of the shank through the screw head hole recessed into the upper surface of the forward portion of shank;
an upper surface of a heelward part of the shank includes a transverse groove;
the heel strap is secured by the tab of the heel plate;
the heel plate is horizontally rotatable on the pivot:
counterclockwise, open 90°, to expose the transverse groove; or
clockwise, closed over the groove;
the tab of the heel plate secures the heel strap in the transverse groove;
the heel plate includes a protrusion configured to engage a recess in the upper surface of the shank, to limit a rotation of the heel plate to 90° in a plane above the upper surface of the shank;

a ring-pull comprises a thin piece of leather secured around the lifting ring;

the platform includes buttresses;

the platform locating holes are recessed into the buttresses;

the buttresses locate and support the platform locating holes, onto the pegs.

4. A shoe system according to claim 1, in which shoe system:

an upper strap assembly includes:

the toe strap;

the heel strap; and an ankle strap, said ankle strap connects the toe strap to the heel strap.

* * * * *